US012078463B2

(12) United States Patent
D'Acquisto

(10) Patent No.: US 12,078,463 B2
(45) Date of Patent: Sep. 3, 2024

(54) ONE-PIECE ALUMINUM BROADHEAD

(71) Applicant: Andrae D'Acquisto, Bellevue, IA (US)

(72) Inventor: Andrae D'Acquisto, Bellevue, IA (US)

( * ) Notice: Subject to any disclaimer, the term of this patent is extended or adjusted under 35 U.S.C. 154(b) by 0 days.

(21) Appl. No.: 17/803,886

(22) Filed: Jan. 10, 2023

(65) Prior Publication Data

US 2023/0251068 A1 Aug. 10, 2023

Related U.S. Application Data

(60) Provisional application No. 63/372,002, filed on Feb. 4, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 2,816,765 A * 12/1957 Stockfleth ..... F42B 6/08 473/583
4,234,191 A * 11/1980 Erlandson ..... F42B 6/08 473/583
5,044,640 A * 9/1991 DelMonte ..... F42B 6/08 473/584
5,145,187 A * 9/1992 Lewis ..... F42B 6/08 473/584
6,663,518 B1 * 12/2003 Kuhn ..... F42B 6/08 473/583
7,597,637 B2 * 10/2009 Sohm ..... F42B 6/08 473/583
7,942,765 B2 * 5/2011 Odabachian ..... F42B 6/08 473/583
8,313,398 B2 * 11/2012 Baker ..... F42B 6/08 473/583
8,771,113 B2 * 7/2014 Patton ..... F42B 6/08 473/583
10,866,074 B1 * 12/2020 Morton ..... F42B 6/08
2006/0030439 A1 * 2/2006 Muller ..... F42B 6/08 473/583
2023/0258439 A1 * 8/2023 Brodie ..... F42B 6/08 473/583

* cited by examiner

*Primary Examiner* — John A Ricci

(57) ABSTRACT

The present invention generally relates to a one-piece all aluminum broadhead having from 2 to 5 cutting blades, wherein each cutting blade has a tapered thickness wherein the thickness of each blade is from 0.06 inches up to about 0.25 inches immediately behind the cutting edge and a thickness at the base of said blade that is from 1.5 to 2.5 times thicker than the thickness of said blade immediately behind said cutting edge. The broadhead of the invention may be machined as a single component from, for example, bar stock material. One or more steps of the broadhead machining or manufacturing process may be automated, for example by the use of one or more robotic gripping arms. In one embodiment the one-piece all aluminum broadhead has three cutting blades and is hard anodized.

15 Claims, 5 Drawing Sheets

ONE-PIECE ALUMINUM BROADHEAD

FIELD OF THE INVENTION

The present disclosure relates to a one-piece, all aluminum, machined, fixed blade broadhead. More specifically, the present disclosure relates to a one-piece broadhead having two, three or four blades that is machined from aluminum or an aluminum alloy.

BACKGROUND OF THE INVENTION

A variety of arrowheads can be found in the marketplace for use in bow hunting, or other bow and arrow or crossbow activities. A broadhead may have any number of blades, which may be moveable and/or fixed. A broadhead having moveable blades is commonly referred to as a mechanical broadhead, while those with fixed blade are referred to as fixed blade broadheads. Additionally, one or more blades may be designed to be removable and replaceable, for example after wear and tear or dulling of the blades.

Broadheads may be machined as multiple parts that are assembled through welding or other coupling mechanisms. The various individual pieces may cause problems during use of the broadhead, particularly where there are moveable components. Multiple machined pieces may be prone to breakage along weld lines or other joints or hinges. Broadheads machined with multiple parts may also be prone to having individual pieces misplaced, broken, or otherwise malfunction, and if any one of the multiple pieces is lost, malfunctions, or breaks, the entire broadhead is typically rendered inoperable as a result. Furthermore, joints or connection points, such as weld lines or hinges, may affect the aerodynamic properties of the broadhead, and may affect the speed, trajectory, or other parameters or characteristics related to functionality of an arrow or bolt.

The invention overcomes many of the deficiencies of the prior art by providing a one-piece broadhead with no moveable parts that is machined from a solid piece of aluminum or aluminum alloy.

SUMMARY OF THE INVENTION

The present invention relates to one-piece, all aluminum, machined, fixed blade broadhead. The one-piece machined broadheads of the invention may have two, three or four fixed blades that are not moveable, wherein said one-piece broadhead is machined from aluminum or aluminum alloy bar stock material.

DETAILED DESCRIPTION OF THE FIGURES

DETAILED DESCRIPTION OF THE INVENTION

Figure 1:
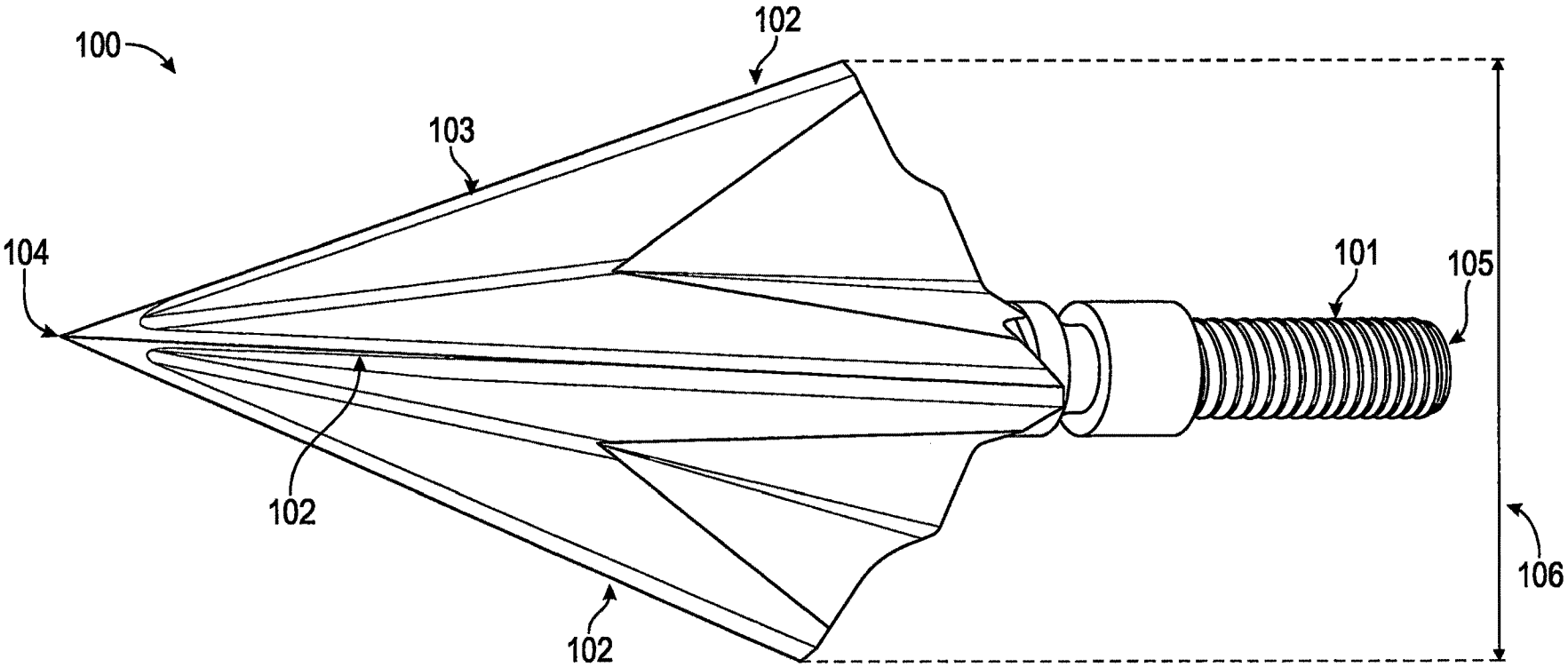
FIG. 1 is a schematic view of a one-piece three blade broadhead according to the invention.

The invention relates to one-piece, all aluminum, fixed blade broadhead machined from aluminum bar stock material. For purposes of this invention, use of the term aluminum shall mean pure aluminum or alloys of aluminum. An aluminum alloy is an alloy in which aluminum is the predominant metal. Any known alloying element may be used in fabricating the aluminum alloy usefully employed in making the broadheads of the invention. The typical alloying elements are copper, magnesium, manganese, silicon, tin and zinc, all of which are included within the scope of this disclosure.

Aluminum is commonly used in the manufacture of broadhead ferrules, but rarely if ever used for the manufacture of broadhead blades. Stainless steel has become the material of choice in broadhead manufacture since it is stronger and heavier than aluminum. Because stainless is stronger, one can make broadhead blades much thinner than they might ordinarily be. One of the other biggest differences between stainless steel and aluminum is in density. Stainless steel is extremely dense in comparison to aluminum, making it much more difficult to scratch stainless steel or in the case of broadheads, sharpen stainless steel blades. Additionally, due to its resistance to wear and abrasion, Stainless steel can be much more difficult and expensive to work with.

The invention seeks to overcome the disadvantages of the prior art by providing a one-piece, all aluminum, fixed blade broadhead machined from aluminum bar stock material. As mentioned above, stainless steel is heavier and stronger than aluminum, but even though stainless steel is stronger, aluminum has a much better strength to weight ratio than stainless steel, which is why aircraft are made from aluminum. In relation to the broadheads of the invention, aluminum is two and one-half times lighter than Stainless Steel which allows one to compensate for strength by manufacturing thicker broadhead blades. Since aluminum is softer, it is much easier and cheaper to machine, aluminum blades are much easier to sharpen, and aluminum is much cheaper than stainless steel. And while steel is stronger and tougher, the aluminum broadheads of the invention are anodized, in another embodiment hard anodized, rendering them much stronger than they would otherwise be. This process ensures the aluminum broadhead's durability and strength without the excessive weight of steel.

Aluminum anodizing is typically referred to by its three types. Type I is chromic acid anodize (or chromic alternatives) which are very thin on the order of 0.0001" thick. Type II is the conventional sulfuric acid anodize which can be decoratively dyed nearly any color and results in a thickness of 0.0002-0.0006". Hardcoat Anodize is Type III which is done under more exacting process conditions resulting in a harder, denser, thicker, and more abrasion resistant coating. Hardcoat thicknesses can vary from 0.0005 to 0.0030" and beyond but is dependent on the specific alloy being anodized. Other less common types are phosphoric acid and titanium anodize. All types on anodizing can be usefully employed in the context of the invention.

Undyed, that is Class 1, hardcoat anodize will change the color of the aluminum dependent on the particular alloy and the anodic thickness. The color of the aluminum after being hard coat anodized depends on the alloy and the thickness of the coating. Many of the 6xxx-series of aluminum will take on a deep gray-black color while most 7xxx and 2xxx series will appear a more bronze-gray color. On some alloys, the color of the aluminum after hardcoat anodizing will be gray/bronze. For dyed Class 2 coatings, black is by far the most commonly specified and will take on a very pleasing, uniform appearance.

In one embodiment, hard anodizing is the anodizing on choice. Hard anodized aluminum is thicker than standard anodized aluminum. Aluminum is already a very lightweight and versatile material; hard anodizing not only improves aesthetics but furthers the strength and corrosion-resistant properties aluminum already possesses. Type III hard anodize is commonly performed clear or with a black dye finish as this creates the most uniform finish. Hard anodized is typically produced using low temperatures and higher current density to accomplish this thickness. A thicker surface gives hard anodized aluminum a more abrasion-resistant surface. It also has a more uniform surface than regular anodized aluminum.

Hardcoat Anodize or simply Hard Anodize is a dense anodic coating of aluminum oxide applied by converting a properly cleaned and deoxidized aluminum alloy component into an oxide film using a suitable electrolyte, typically sulfuric acid cooled to nearly freezing, and applied voltages upwards of 100 volts at an applied current density of 24-36 amps per square foot. In anodizing, DC electricity converts the aluminum metal on the surface of the broadhead to non-conductive aluminum oxide; simultaneously the acid in the electrolyte is dissolving the coating. The process is thus self-limiting—because the oxide impedes current flow and when it reaches a certain thickness the current flow cannot build a coating any faster than the acid dissolves it. So, in simplest terms, hard anodizing involves a higher voltage rectifier and lower temperatures (of about 28° F. rather than 68° F.) which allows more current to flow for a heavier build, while reducing the acid attack on the coating.

All anodizing is a conversion coating in that a portion of the base materials surface is converted from raw aluminum into aluminum oxide. In general terms, for Type III anodize ½ of the coating thickness penetrates into the surface of the parts while the other ½ builds up on the surface. Thus, for a typical 0.002" thickness requirement, there is 0.001" dimensional change per surface on the broadhead of the invention.

The hardcoat anodize is generally left unsealed (other than an optional PTFE sealing). Alternatively, the hardcoat anodize can optionally be sealed. In general, all dyed hardcoat anodize is required to be sealed in order to ensure the dye won't fade or bleach out. Sealing can be accomplished using deionized water, sodium dichromate, nickel acetate, PTFE or a combination of two or more of these.

In general, the hardcoat anodize utilized on the broadheads of the invention are governed by the following specifications.

MIL-A-8625, Type III
AMS 2469
ASTM B580, Type A
ISO 10074
MIL-A-63576 (PTFE Sealed)
AMS 2482 (PTFE Sealed)

Type III anodize can also be performed using polytetrafluoroethylene (PTFE) based formulas, the best-known brand name being Teflon, and is a very durable anodize solution. A Teflon hardcoat will also lower the coefficient of friction, up to 50% lower than that of hard anodizing, making it more slippery. This makes the surface more suitable for aluminum molds as the lubricity translates into superior release characteristics and the coating remains stable at relatively high temperatures as well. These added characteristics make hardcoat/PTFE applications an attractive choice for use with the broadheads of the invention.

Type III anodizing can be done in both dyed and non-dyed formats and can replace stainless steel in many applications, including in combination with the broadheads of the invention, yielding savings in material costs, maintenance, and part replacement, to name a few. Some additional benefits of hardcoat anodized components compared to stainless steel include:

Less weight
Less expensive to produce, handle & ship
Machining is twice as fast as for stainless steel
Tight tolerances—machine components with can be anodized without changing the dimensional requirements of the part
Energy Cost Savings—anodized aluminum replaces hardened-steel molds for plastic injection molding, saving on energy costs due to the heat retention properties of anodized aluminum, as one example There is no "typical" hardness for Type III anodic coatings. Vickers Hardness 360 is roughly equivalent to Rockwell C of 37. The hardness of the coating depends on alloy and the anodizing conditions. Hardness can be compared to wear resistance only under like conditions. Under certain conditions of process and alloy, a Rockwell C hardness of 50 to 60 (520-700 HV) can be produced for Type III anodic coatings. This hardness rivals that of stainless steel. A harder coating, and perhaps a thicker coating, might show better wear resistance than a less hard and/or thinner coating under the same test or application conditions. In the context of the present invention it is preferable, in one embodiment, that the hardness of the hardcoat anodize coating on the broadhead of the invention rival that of stainless steel.

Hardcoat anodizing generally requires the following steps.

Pre-Treatment

This is the first step in the anodizing of aluminum. Here, the aluminum alloy component gets adequately cleaned and deoxidized through the application bright or satin finish to the aluminum component. As such, this helps remove grease and surface dirt.

Satin finishing comprises light etching to create an even and appealing matte surface finish. More so, this process uses hot sodium hydroxide solution to remove the aluminum material's surface inadequacies.

Bright finishing produces a near mirror finishing with a concentrated mixture of phosphoric and nitric acids. Thus, this process smoothens and cleans the aluminum surface.

Hard Anodizing Process

Generally, hard coat anodize gets formed by the electrochemical reaction of aluminum with oxygen. Furthermore, the process involves using sulfuric acid and low bath temperatures. You'll find that sulfuric acid is the most common electrolyte for type III (3) hard coat anodizing. Below are procedures for aluminum hard coat anodizing:

i. First, the aluminum part gets racked to make the anode and then immersed in sulfuric acid solution. The sulfuric acid bath contains about 180 to 200 grams per liter of acid and minute amounts of dissolved aluminum parts.
ii. Then air bubbles through the acid. This air bubble agitation circulates the sulfuric acid solution.
iii. Further, circulation aids in cooling the sulfuric acid to a near-freezing temperature. Thus, the oxygen for the hard coat anodizing reaction comes from the sulfuric acid bath.
iv. The oxygen then combines with aluminum to produce a measurable oxide film. This occurs when voltages of about 100 volts upwards get applied at a current density of 24 to 40 amps per square foot.

v. The current is continually applied until the desired oxide thickness forms. Meanwhile, the operating temperatures remain at the freezing point of water between −2 to 0° C.

vi. Note that this coating is chemically bonded to the substrate, thus forming the hard coat anodize.

The hard anodize thicknesses vary from 0.0005 to 0.006" (13 to 150 microns) thick, depending on the specific aluminum alloy. Moreover, forming thick films requires higher voltage and controlled processing in refrigeration tanks.

The hardness of hard anodic coating varies depending on the aluminum alloy selected. Regular anodized aluminum with a softer coating has a hardness of about 200 to 400 HV, thus suitable for decorative purposes. Meanwhile, a typical hard coat anodize has a consistent hardness of about 400 to 600 HV along the entire section of the aluminum part. This makes hard coats ideally suited for the broadheads of the invention. Also, the wear resistance of hard anodized aluminum components compares agreeably with hard chromium and high-speed steel. Thus, hard anodic coatings are ten times more wear resistant than regular anodic films.

Figure 4:
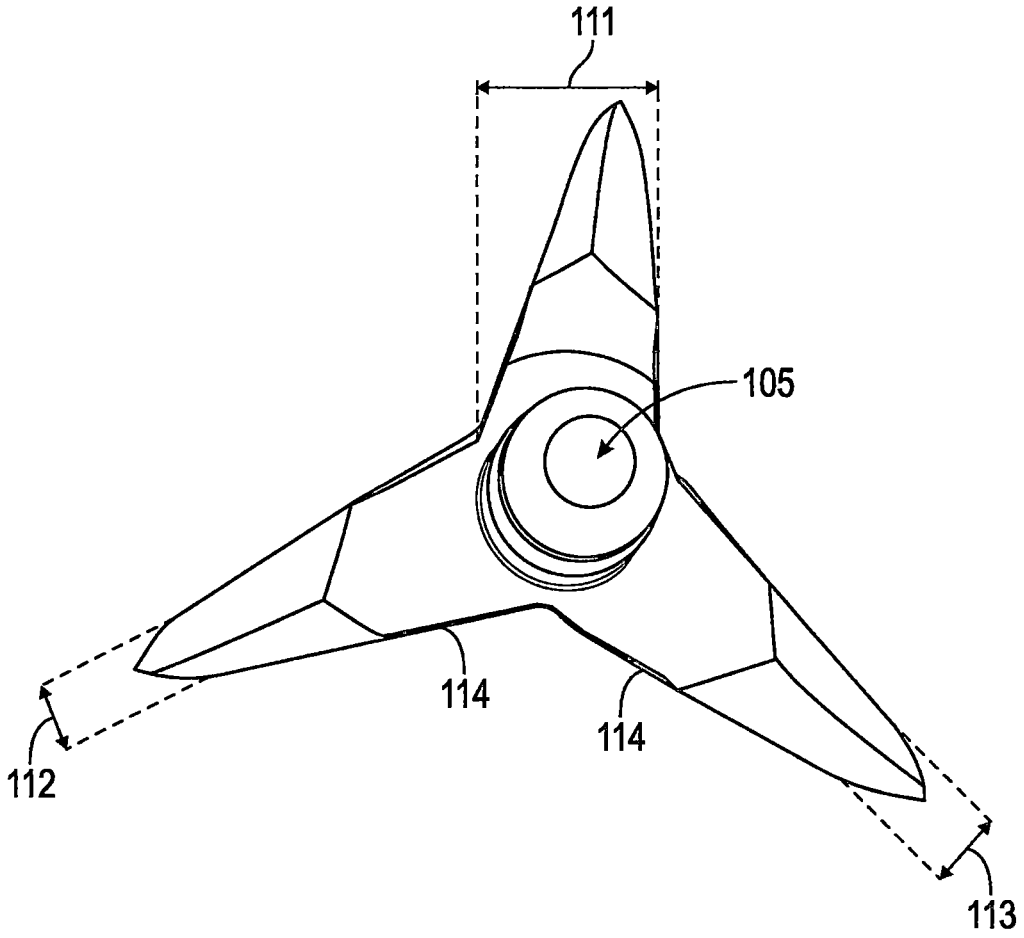
FIG. 4 is a back-end view of the broadhead of the invention.
Figure 5:
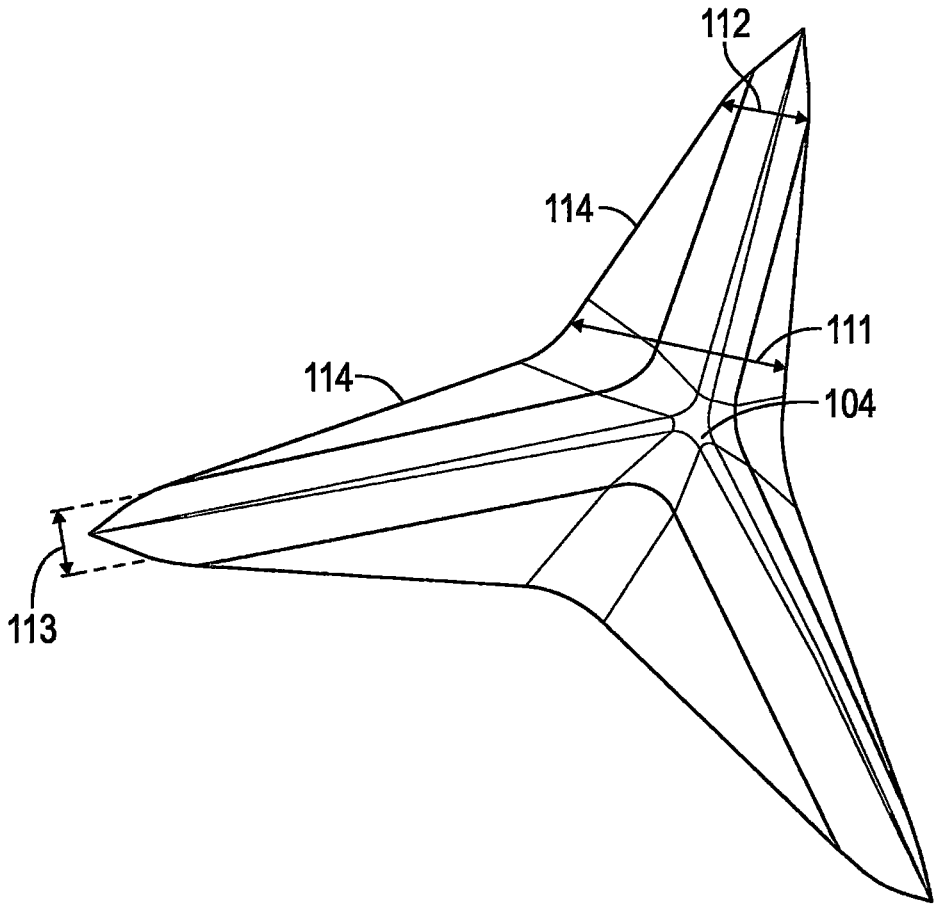
FIG. 5 is a front-end view of the broadhead of the invention.

The one-piece aluminum broadheads of the invention that have been anodized, in another embodiment hard anodized, have the following characteristics:

Increased abrasion resistance and strength
Increased wear resistance
Increased corrosion resistance
Improved aesthetics
Improved wear resistance
Non-conductive
Can repair worn surfaces on aluminum
Improve parts surface for slide applications
Can be black dyed; other colors less decorative
Finish is harder than tool steel
Can be ground or lapped In one embodiment, the one-piece aluminum broadhead is made from aluminum bar stock material. The broadhead on the invention can have 2, 3, 4 or 5 blades, in another embodiment 3 or 4 blades, and in another embodiment 3 blades. In one preferred embodiment the one-piece broadhead of the invention has 3 fixed blades made from aluminum bar stock material, the broadhead having an attachment end for attaching to an arrow and a pointed end opposite the attachment end. In another embodiment the one-piece broadhead of the invention has 4 fixed blades made from aluminum bar stock material, the broadhead having an attachment end for attaching to an arrow and a pointed end opposite the attachment end. It is preferred, but not required that the blades of the broadhead of the invention be spaced approximately an equal distance apart. For example, as shown in FIG. 4, the blades of a one-piece 3-blade broadhead according to the invention are spaced an equal distance apart 114, i.e., approximately 60 degrees apart one from the other. In a 4-blade broadhead the blades are spaced approximately 45 degrees apart, one from the other, and so on.

The broadhead of the invention is optionally machined from bar stock material such that an attachment end of the broadhead is nearer the open end of the bar stock than an end of the broadhead resulting in the pointed end. The machining may be performed on a Swiss screw machine. In some embodiments, the Swiss screw machine includes a first spindle and a second spindle, and a first portion of the broadhead is machined on the first spindle and a second portion of the broadhead is machined on the second spindle. In certain embodiments, the first portion may include all rough machining excluding at least a final point at the end of the broadhead resulting in the pointed end. Furthermore, the second portion may include at least the final point of the broadhead. Still further embodiments may include cutting the broadhead from the bar stock material after the first portion of the broadhead is machined, and before the second portion of the broadhead is machined. In some embodiments, the method may include grinding each of the broadhead's blades to the desired angle. A first robotic gripping arm and a second robotic gripping arm may facilitate the grinding step. More specifically, a first robotic gripping arm may remove a first broadhead from an array of broadheads and load the first broadhead into a grinder, and a second robotic gripping arm may unload the first broadhead from the grinder after grinding is complete. As mentioned above, the broadhead of the invention is optionally anodized, in another embodiment hard anodized.

The one-piece broadheads of the invention can also be manufactured in an array. More specifically, a plurality of broadheads is placed in an array; and for each of the plurality of broadheads: using a first robotic gripping arm, removing the broadhead from the array and positioning it in a grinding machine; grinding the four blades of the broadhead to an included angle; and using a second robotic gripping arm, removing the broadhead from the grinding machine. In still further embodiments, the machining is performed on a Swiss screw machine. More specifically, the Swiss screw machine used may include a first spindle and a second spindle, wherein a first portion of the broadhead is machined on the first spindle and a second portion of the broadhead is machined on the second spindle. As indicated above, in some embodiments, the first portion may include all rough machining excluding at least a final point at an end of the broadhead.

As previously mentioned, while aluminum is not as stainless strong as steel, it is roughly one third the weight of stainless steel and has a superior strength to weight ratio. Because of the superior strength to weight ratio of aluminum, the blades of the present broadhead can be fabricated substantially thicker than the blades of stainless broadheads. The thicker blades compensate for the reduced strength of aluminum without adding additional weight due to the superior strength to weight ratio of aluminum.

In one embodiment the blades of the broadheads of the invention have a thickness of greater than 0.05 inches up to about 0.3125 inches; in another embodiment greater that 0.06 inches, in another embodiment greater than 0.07, or 0.08, or 0.09, or 0.1 inches up to about 0.3125 inches. In another embodiment the broadhead of the invention has a blade thickness of from about 0.8 inches to about 0.25 inches. In another embodiment, the blade thickness of the invention of from about 0.1 to about 0.25 inches.

In still another embodiment the blades of the present broadhead are tapered, wherein the thickness of the blade at its base (111) is at least 1.5 times the thickness of the blade at its outer edge immediately behind (112) the blade cutting edge (113). In this embodiment, if the blade thickness immediately behind the cutting edge is 0.1 inches, then the blade thickness at its base is 0.15 inches. In another embodiment the blades of the present broadhead are tapered, wherein the thickness of the blade at its base (111) is from 1.5× to 5× the blade thickness at its outer edge (112). In yet another embodiment the thickness of the blade at its base (111) is from 2.0× to 3.5× the blade thickness at its outer edge (112).

In one preferred embodiment the invention relates to a one-piece all aluminum broadhead having 3 or 4 cutting blades, wherein said broadhead has an attachment end for attaching to an arrow and a pointed end opposite the attachment end and wherein the cutting blades of said broadheads have no apertures, wherein each of said cutting blades has a cutting edge and wherein each blade has a tapered thickness such that each blade has a thickness of from greater than 0.06 inches up to about 0.3 inches immediately behind the cutting edge of said cutting blade and a thickness at the base of said blade that is 1.5 to 2.5 times thicker than the thickness of said blade immediately behind said cutting edge. In another embodiment each blade has a thickness of from greater than 0.08 inches up to about 0.25 inches immediately behind the cutting edge of said cutting blade and a thickness at the base of said blade that is 1.5 to 2.0 times thicker than the thickness of said blade immediately behind said cutting edge.

The cutting diameter 106 of the broadheads of the invention is non-limiting. In one embodiment the cutting diameter ranges from ¾ inch to 2 inches; in another embodiment ¾ inch to 1½ inch and in yet another embodiment from ⅞ inch to 1½ inch, and in another embodiment from 1 to 1¼ inch in diameter. The weights of the broadheads of the invention are also not limiting. In one embodiment, the weight ranges from 75 grains to 150 grains; in another embodiment 100 to 125 grains. Because aluminum is lighter than steel, a broadhead of the invention having a 1½ inch cutting diameter can be easily fabricated at 100 grains, roughly the weight of a steel broadhead having a cutting diameter of one inch. Because the broadhead of the present invention is made from aluminum, a broadhead having a larger cutting diameter 106 can be made lighter, which may improve both the speed and/or trajectory of same.

Where a range of values describes a parameter, all sub-ranges, point values and endpoints within that range or defining a range are explicitly disclosed therein. All physical properties, parameters, dimensions, and ratio ranges and sub-ranges, including endpoints, between range endpoints for those properties, parameters, dimensions and ratios are considered explicitly disclosed therein.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

While the specification concludes with claims particularly pointing out and distinctly claiming the subject matter that is regarded as forming the various embodiments of the present disclosure, it is believed that the invention will be better understood from the following description taken in conjunction with the accompanying Figures.

Figure 2:
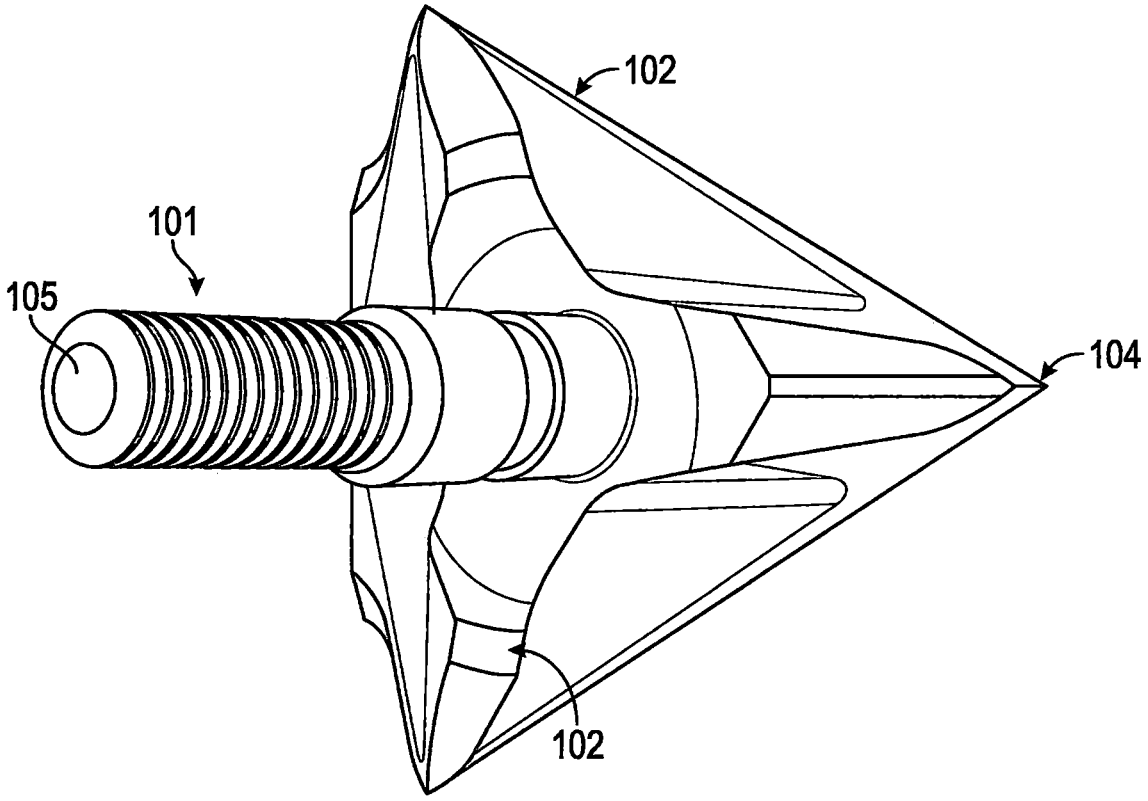
FIG. 2 is a right-side angled view of a one-piece three blade broadhead of the invention.
Figure 3:
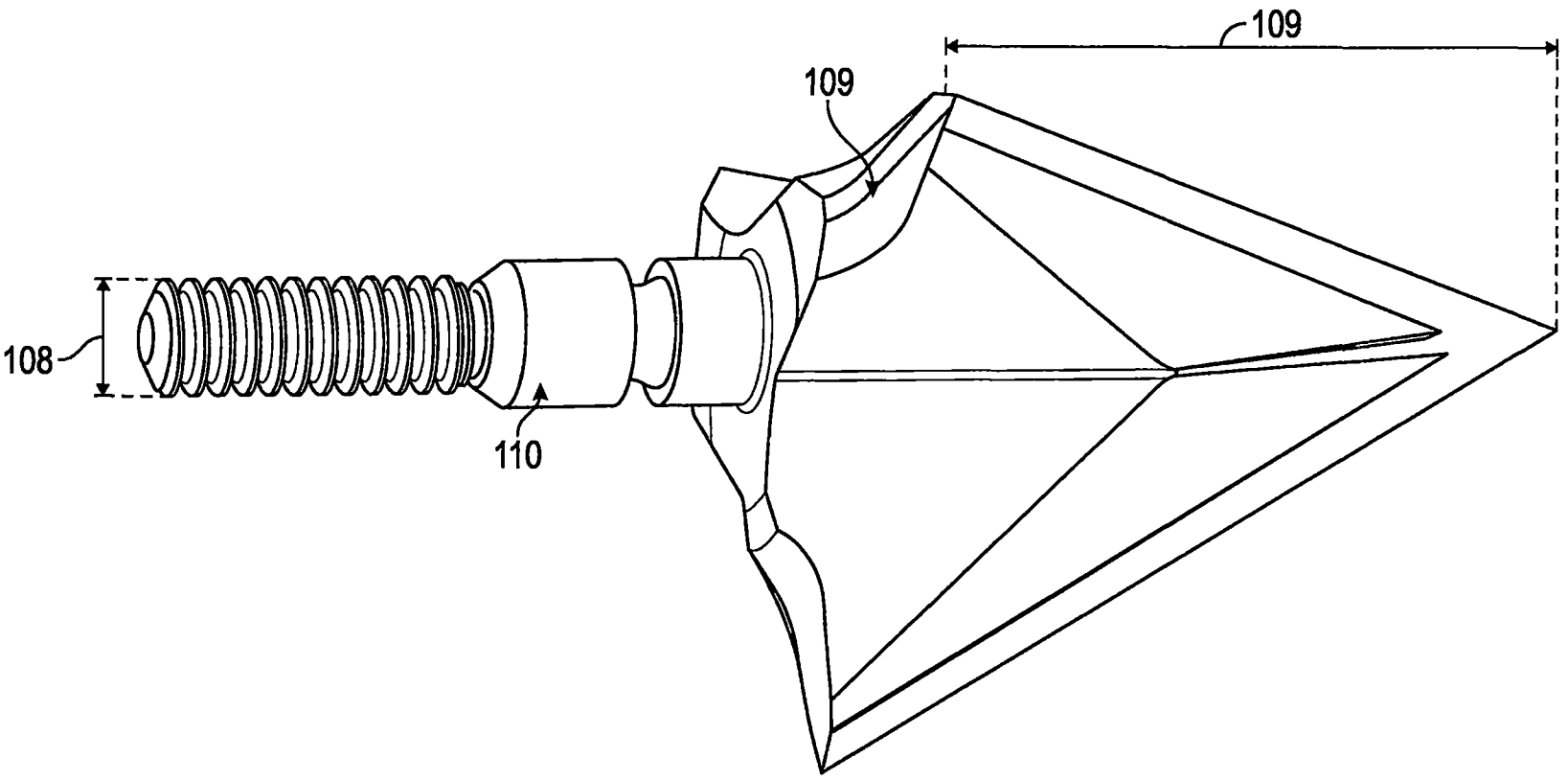
FIG. 3 is an additional right-side view of the three blade broadhead of FIG. 1.

FIGS. 1 and 2 illustrate a one-piece three-blade broadhead according to the present invention. The broadhead 100 may have a central shaft 105 supporting three blades 102 that extend outward from the shaft. A point 104 is formed at the front end of the shaft 105. The broadhead 100 may have an attachment mechanism 101 at the end of the shaft opposite the point 104, for attaching or coupling the broadhead to an arrow or crossbow bolt shaft.

The central shaft 105 of the broadhead 100 is generally round or other suitable cross section and may be of any suitable length. In one embodiment, the length of the shaft 105 is from 0.75 to 2.5 inches in length. In one embodiment the shaft 105 is optionally segmented into multiple sections, each which may have the same or different width or diameter and/or cross-sectional shape. For example, the shaft 105 may have a second section 110 extending from the first section 105 that may have second maximum width or diameter, which may be equal to, larger than, or smaller than the diameter of the shaft 105. The second section 110 may also have any suitable length, and may be equal to, longer, or shorter than the shaft 105. The transition between the shaft 105 and the second section may be a gradual taper or stepped transition in other embodiments. In another embodiment, the second section 110 is relatively smooth or it may be textured or countered as desired.

The broadhead 100 comprises an attachment means 101 by which the broadhead is coupled to an arrow. The attachment means 101 is generally located near the end of the shaft 105 opposite the point 104. The attachment mechanism 101 may be any means of attachment, such as but not limited to, threading, or any other suitable attachment means. In a preferred embodiment the attachment means 101 is threading, which extends from a distance behind the broadhead blades 102 to the end of the shaft 105 opposite the point 104. In other embodiments, the attachment means 101 may be located at any suitable point along the shaft 105, such that the broadhead 100 may be suitably coupled to an arrow. The attachment mechanism 101 may be sized for standard or custom sizes or types of arrows or crossbow bolts.

In one embodiment the broadhead of the present invention is a three-blade broadhead 100, such as that shown in the figures. Each of the three blades 102 generally extend radially or outward from the shaft 105. Each blade 102 is of generally triangular shape as viewed from the side of the blade, wherein two points of the triangle are along the shaft 105, and a third point lies radially outward from the shaft. The triangular shape may have any suitable angles and edge lengths. In other embodiments, the blades 102 extend from the shaft 105 in any suitable shape, such as in an arc, rectangular, or other polygonal shape. In some embodiments, one or more blades 102 may generally spiral or twist circumferentially around the shaft 105 as it extends radially, while in other embodiments, the blades 102 may simply extend radially from the shaft 105 at a generally perpendicular direction from the longitudinal axis of the shaft, as illustrated in FIGS. 1 and 2. In other embodiments, the blades 102 may radially extend from the shaft 105 at any suitable angle or angles. Each blade 102 may extend a distance of between about 0.1 to 1.5 inches, or any other suitable distance 109 out from the shaft 105. The three blades 102 are generally arranged equidistant from one another circumferentially around the shaft 105. The distance between the outermost points of two blades 102 on opposite sides of the shaft 105, and thus a maximum width or diameter 106 of the broadhead 100, may be of any suitable diameter 106, in one embodiment from about 0.5 and 3.0 inches; in another embodiment from 0.75 to 1.5 inches, and in another embodiment from 1 to 1.25 inches, in yet another embodiment 1 inch.

One or more blades 102 have a sharpened edge 103 on one or more sides of the blade. In one embodiment, the edges are sharpened to a 45 degree included angle. In another embodiment the blades 102 do not have any contours and/or apertures and/or through holes through them and are solid. The present inventors have found that the one-piece aluminum broadheads of the invention having blades with no apertures or no holes through them are not only stronger, but also have reduced drag both during flight and as the broadhead passes through an animal.

The broadhead of the is made or machined from aluminum or an aluminum alloy bar stock material of suitable diameter or width. The maximum diameter of the finished broadhead should be substantially equal to the diameter of the bar stock used in the machining process. For example, where bar stock with one-inch diameter is used to machine a broadhead 100 of the present disclosure, the resulting broadhead may similarly have a maximum diameter 106 of one inch. In other embodiments, the final width or diameter of the broadhead may differ than that of the bar stock used. A machined broadhead of the present disclosure may be of any standard broadhead weight including but not limited to 75 grain, 85 grain, 90 grain, 100 grain, or 125 grain, for example. In other embodiments, a machined broadhead of the present disclosure may have any suitable weight. The broadhead of the present disclosure machined as a single component. That is, a broadhead of the present disclosure is formed as one piece without the need for welding or other coupling devices. In this way, a single-piece machined broadhead of the present disclosure have improved aerodynamics, and less prone to breakage. The broadhead of the invention can be manufactured according to any method of manufacture within the knowledge and skill of the skilled artisan, including by machining, including machining in an automated process or through use of a robotic process.

The broadheads of the invention may be fabricated from heat treated aluminum, or they can heat treated after manufacture. Heat treatment or other strengthening methods may harden the broadhead and/or increase its hardness or strength or to bring the hardness of the broadhead to a desirable level. Any suitable process or method may be used to heat treat the broadhead of the present invention. Heat treating may be performed at any point in the manufacturing process, i.e., on the starting aluminum and/or aluminum alloy, prior to machining, in between machining steps, or after machining the final product.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

I claim:

1. A machined one-piece all aluminum or aluminum alloy broadhead comprising 2 to 5 cutting blades, wherein said broadhead has an attachment end for attaching to an arrow and a pointed end opposite the attachment end, and wherein the blades of said broadhead have no apertures, the thickness of the blades is greater than 0.05 inches up to about 0.3125 inches and wherein the blade thickness is tapered such that the thickness of each blade at its base is at least 1.5 times thicker than the thickness of said blade immediately behind said cutting edge, wherein said broadhead is heat treated and hardcoat anodized.

2. The broadhead of claim 1 having 2, 3 or 4 cutting blades.

3. The broadhead of claim 2 wherein said broadhead had a cutting diameter of 1 to 1/¼ inches and a weight of 100 to 150 grains.

4. The broadhead of claim 2 wherein each of said cutting blades have a thickness of from 0.6 to about 0.25 inches.

5. The broadhead of claim 2, wherein said broadhead has three cutting blades wherein each of said cutting blades are configured to be approximately 60 degrees apart one from the other.

6. The broadhead of claim 2, wherein said broadhead has two cutting blades wherein each of said cutting blades are configured to be approximately 180 degrees apart one from the other.

7. The broadhead of claim 2 wherein the cutting blades have a cutting edge, wherein the blade thickness is tapered such that the thickness of each blade at its base is at least 2.0 times thicker than the thickness of said blade immediately behind said cutting edge.

8. The broadhead of claim 7 wherein each of said cutting blades has a cutting edge, wherein the blade thickness is tapered such that the thickness of each blade at its base is from 3 to 5 times thicker than the thickness of said blade immediately behind said cutting edge.

9. The broadhead of claim 1 which comprises four cutting blades wherein each of said blades has a thickness of from 0.6 to about 0.25 inches.

10. He broadhead of claim 9, wherein each of the broadhead's four cutting blades are configured to be approximately 45 degrees apart one from the other.

11. The broadhead of claim 10 wherein the blade thickness is tapered such that the thickness of each blade at its base is at least 2.0 times thicker than the thickness of said blade at its outer portion.

12. The broadhead of claim 11 wherein the blade thickness is tapered such that the thickness of each blade at its base is at least 3.0 to 5 times thicker than the thickness of said blade at its outer portion.

13. A one-piece all aluminum or aluminum alloy broadhead comprising 3 cutting blades, wherein said broadhead has an attachment end for attaching to an arrow and a pointed end opposite the attachment end and wherein the cutting blades of said broadheads have no apertures, wherein each of said cutting blades has a cutting edge and wherein each blade has a tapered thickness wherein the thickness of each blade is from 0.06 inches up to about 0.25 inches immediately behind the cutting edge and a thickness at the base of said blade that is at least 1.5 to 2.5 times thicker than the thickness of said blade immediately behind said cutting edge.

14. The one-piece broadhead of claim 13 wherein each blade has a thickness of from 0.08 to about 0.2 inches immediately behind the cutting edge of said cutting blade and a thickness at the base of said blade that is 1.5 to 2.0 times thicker than the thickness of said blade immediately behind said cutting edge.

15. The broadhead of claim 13 which is hard anodized.

* * * * *